US010588179B2

(12) United States Patent
Kim et al.

(10) Patent No.: US 10,588,179 B2
(45) Date of Patent: Mar. 10, 2020

(54) INDUCTION HEATING DEVICE

(71) Applicant: LG ELECTRONICS INC., Seoul (KR)

(72) Inventors: Wansoo Kim, Seoul (KR); Seongjun Kim, Seoul (KR); Byungkyu Park, Seoul (KR); Yangkyeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 278 days.

(21) Appl. No.: 15/470,170

(22) Filed: Mar. 27, 2017

(65) Prior Publication Data

US 2017/0280512 A1 Sep. 28, 2017

(30) Foreign Application Priority Data

Mar. 28, 2016 (KR) ..... 10-2016-0036663

(51) Int. Cl.

| | |
|---|---|
| ***H05B 6/12*** | (2006.01) |
| ***F24C 7/10*** | (2006.01) |
| ***H05B 6/06*** | (2006.01) |
| *H05B 6/02* | (2006.01) |

(52) U.S. Cl.

CPC ..... *H05B 6/1209* (2013.01); *F24C 7/10* (2013.01); *H05B 6/062* (2013.01); *H05B 6/02* (2013.01); *H05B 6/1236* (2013.01); *H05B 6/1245* (2013.01)

(58) Field of Classification Search

CPC . H05B 6/02; H05B 6/062; H05B 6/12; H05B 6/1209; H05B 6/1236; H05B 6/1245; H05B 6/1254; H05B 6/1263; F24C 7/10

USPC ..... 219/620, 622, 624, 630, 672, 675, 676, 219/647

See application file for complete search history.

(56) References Cited

U.S. PATENT DOCUMENTS

| | | | | |
|---|---|---|---|---|
| 2008/0000895 | A1* | 1/2008 | Herving | A47J 36/2483 219/620 |
| 2011/0100980 | A1* | 5/2011 | Kitaizumi | H05B 6/1245 219/624 |

FOREIGN PATENT DOCUMENTS

| | | |
|---|---|---|
| JP | S62195887 | 8/1987 |
| JP | H0629087 | 4/1994 |
| WO | 2008022685 | 2/2008 |
| WO | 2009157844 | 12/2009 |

OTHER PUBLICATIONS

Extended European Search Report in European Application No. 17163051, dated Aug. 3, 2017, 8 pages (with English translation).

* cited by examiner

*Primary Examiner* — Hung D Nguyen
(74) *Attorney, Agent, or Firm* — Fish & Richardson P.C.

(57) ABSTRACT

An induction heating device is disclosed. The induction heating device includes a working coil for creating a magnetic field for induction of eddy currents in cooking equipment so as to heat the cooking equipment, a power supply unit for providing induction voltage to operate the working coil, and a case for accommodating the power supply unit and the working coil. The case includes a first case and a second case, and the first case and the second case define therebetween an insertion space into which a plate is fitted.

20 Claims, 10 Drawing Sheets

INDUCTION HEATING DEVICE

CROSS-REFERENCE TO RELATED APPLICATION

This application claims the priority benefit of Korean Patent Application No. 10-2016-0036663, filed on Mar. 28, 2016 in the Korean Intellectual Property Office, the disclosure of which is incorporated herein by reference.

BACKGROUND OF THE INVENTION

1. Field of the Invention

The present invention relates to an induction heating device, and more particularly to an induction heating device that is capable of being easily mounted to or demounted from a table or the like and that has a beautiful appearance.

2. Description of the Related Art

In general, a table in restaurants or homes is used for having meals or placing objects thereon.

In recent years, induction heating devices configured to generate heat using an induction heating method, which is environmentally friendly and does not generate gaseous carbon, are attracting attention.

Conventionally, tabletop induction heating devices, which are placed on the table when used, have been manufactured. Such a conventional tabletop induction heating device comprises a working coil for induction-heating cooking equipment, an inverter for supplying induction current to the working coil, and a cooling unit for cooling the inverter. The tabletop induction heating device is manufactured to have a relatively thin thickness in terms of appearance. However, the thin thickness may cause a problem in that the components of the induction heating device are so close to each other that undesirable heat generation or an electrical short-circuit occurs. Therefore, there is a limitation to the extent to which the thickness of the induction heating device can be reduced.

Further, the tabletop induction heating device may undesirably move on the table, which may cause an accident during cooking.

SUMMARY OF THE INVENTION

Therefore, the present invention has been made in view of the above problems, and it is an object of the present invention to provide an induction heating device that is capable of being easily mounted to or demounted from a table.

It is another object of the present invention to provide an induction heating device, a portion of which is located beneath a table, leading to an improved appearance.

It is a further object of the present invention to provide an induction heating device that is capable of effectively dissipating heat.

In accordance with the present invention, the above and other objects can be accomplished by the provision of an induction heating device including a working coil for creating a magnetic field for the induction of eddy currents in cooking equipment so as to heat the cooking equipment, a power supply unit for providing induction voltage to operate the working coil, and a case for accommodating the power supply unit and the working coil. The case includes a first case and a second case, and the first case and the second case define therebetween an insertion space into which a plate is fitted.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
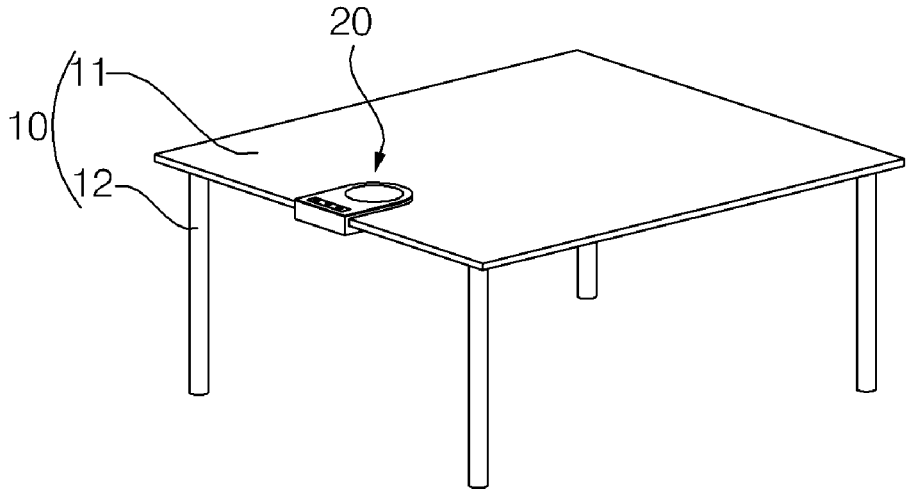
FIG. 1 is a conceptual view illustrating the exemplary use of an induction heating device according to a first embodiment of the present invention.

Advantages and features of the present invention and methods for achieving those of the present invention will become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope of the present invention. The same reference numerals may refer to the same elements throughout the specification.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Hereinafter, exemplary embodiments of the present invention will be described with reference to the accompanying drawings.

Figure 2:
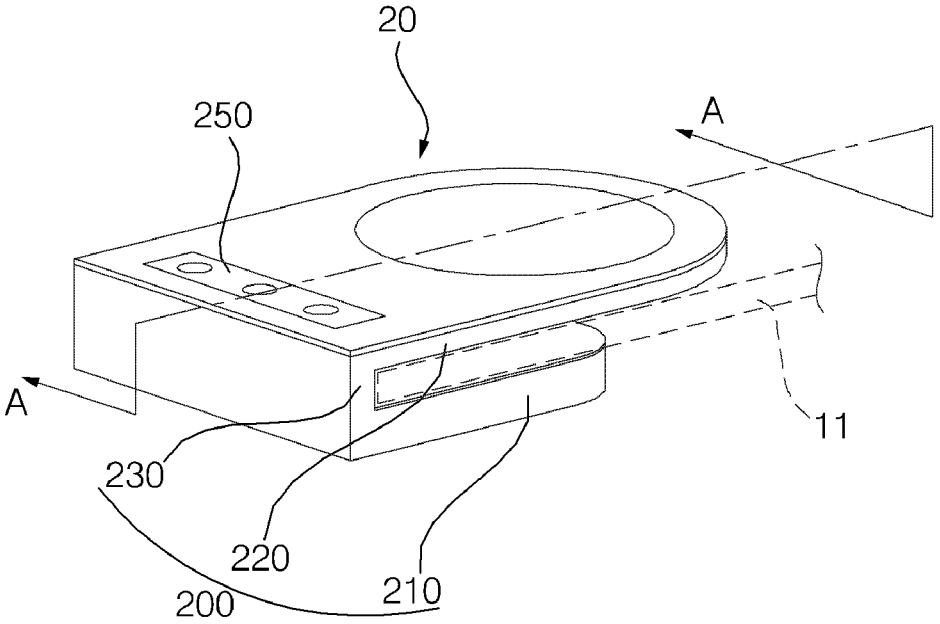
FIG. 2 is a view illustrating the induction heating device according to the first embodiment of the present invention.
Figure 3:
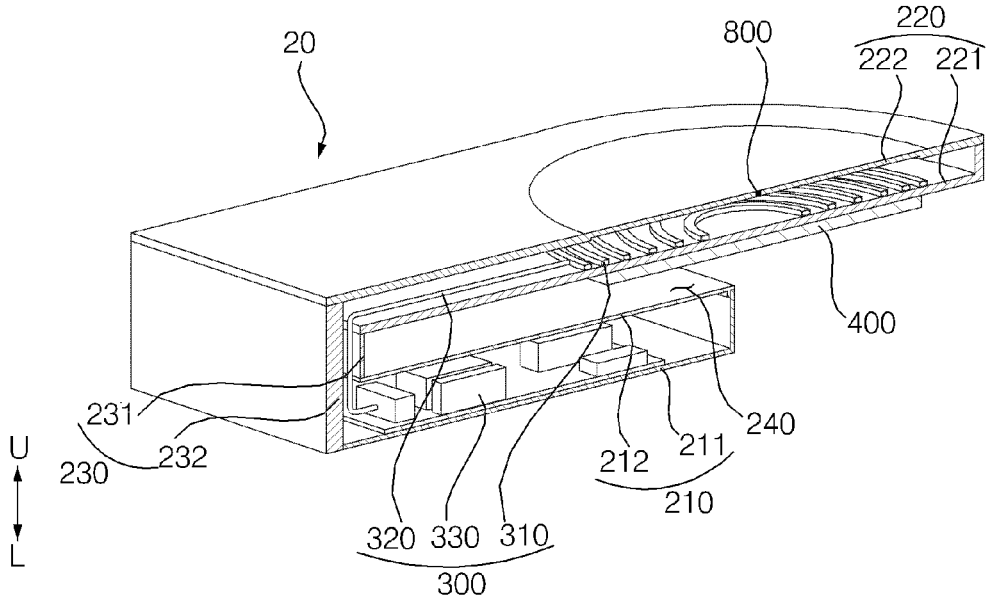
FIG. 3 is a sectional view taken along line A-A in the induction heating device depicted in FIG. 2.

FIG. 1 is a conceptual view illustrating the exemplary use of an induction heating device according to a first embodiment of the present invention, FIG. 2 is a view illustrating the induction heating device according to the first embodiment of the present invention, and FIG. 3 is a sectional view taken along line A-A in the induction heating device depicted in FIG. 2.

Referring to FIGS. 1 to 3, an induction heating device according to the first embodiment of the present invention comprises a working coil 310, which creates a magnetic field for the induction of eddy currents in cooking equipment so as to heat the cooking equipment, a power supply unit 330, which provides induction voltage to operate the working coil 310, and a case, which accommodates the power supply unit 330 and the working coil 310 and includes a first case 210 and a second case 220.

The induction heating device 20 heats cooking equipment through the induction of eddy currents in the cooking equipment. The induction heating method is a method of heating metal using an electromagnetic induction phenomenon. The induction heating device 20 may act as a wireless charging transmitter for supplying power to electronic equipment through interaction with a wireless charging receiver provided at the electronic equipment.

The working coil 310 heats the cooking equipment. The working coil 310 creates a magnetic field using induction voltage supplied from the power supply unit 330 and heats the cooking equipment through the induction of eddy currents in the cooking equipment. Therefore, the induction heating device 20 conveys reduced burn risk and does not emit gaseous carbon or particulate matter, unlike a conventional method of directly heating cooking equipment using a fossil fuel or the like.

The working coil 310 may be shielded by a protection member (not shown). The protection member (not shown) covers two opposite sides or the entire area of the working coil 310 so as to protect the working coil 310 from external shocks.

The power supply unit 330 is electrically connected with an external power source so as to provide induction voltage. The power supply unit 330 may be a well-known inverter for converting power from the external power source into induction voltage.

A conventional tabletop induction heating device, in which a power supply unit and a working coil are disposed in close contact with each other, has a problem of undesirable heat generation and an electrical short-circuit. Meanwhile, the induction heating device according to the embodiment, as described below, is constructed such that the case is divided into two sections, which are spaced apart from each other and in which the power supply unit 330 and the working coil 310 are located, respectively, so as to be spaced apart from each other, and a plate 11 of a table 10 is fitted into a space between the two divided sections of the case, thereby solving the above problem with the prior art.

The case accommodates the power supply unit 330 and the working coil 310 and forms the outer appearance of the induction heating device 20.

The case may be formed of a material that does not interrupt the generation of electromagnetic induction between the induction heating device and electronic equipment or cooking equipment and that has a predetermined thermal resistance and hardness. Further, the case may include a transparent material and/or a translucent material, through which light emitted from a light source 260, which will be described later, passes. Preferably, the case has thermal resistance, light transmissivity and a non-magnetic property. For instance, the case may include any one of a wood material and a resin material; however, the embodiment is not limited thereto.

As an example, the case includes a first case 210 and a second case 220. The case may further include a connection case 230 for connecting the first case 210 and the second case 220.

The first case 210 and the second case 220 define therebetween an insertion space 240 into which a plate 11 is fitted. The first case 210 and the second case 220 are arranged so as to be spaced apart from each other. Further, the first case 210 and the second case 220 are spaced apart from each other so as to face each other.

Here, the plate 11 may be one of various items to which the induction heating device 20 is secured. For instance, the plate 11, as shown in FIG. 1, may be a plate of a table 10, which supports objects placed thereon. The table 10 typically includes a plate 11 and legs 12 for supporting the plate 11.

As a result of the insertion space 240, into which the edge portion of the plate 11 of the table 10 is fitted, being defined between the first case 210 and the second case 220, one of the first case 210 and the second case 220 may be located on the plate 11 and the other one may be located beneath the plate 11, thereby making it possible to reduce the thickness of the upper region of the case, which is located on the plate 11 and can be seen by a user.

The first case 210 and the second case 220 may communicate with each other so as to facilitate electrical connection among the components disposed in the first and second cases 210 and 220. Alternatively, the first case 210 and the second case 220 may be formed so as to define respectively independent spaces.

As an example, the power supply unit 330 is disposed in the first case 210, and the working coil 310 is disposed in the second case 220.

Specifically, the first case 210 may be formed by engaging at least two members so as to define a space for accommodating the power supply unit 330. The first case 210 includes a lower plate 211 and an upper plate 212 configured to be coupled to the lower plate 211 so as to define a space for accommodating the power supply unit 330.

The second case 220 may be formed by engaging at least two members so as to define a space for accommodating the working coil 310. The second case 220 includes a lower plate 221 and an upper plate 222 configured to be coupled to the lower plate 221 so as to define a space for accommodating the working coil 310.

A pressure sensor 800 may be provided at the second case 220 so as to detect whether cooking equipment is placed on the region of the second case 220 that overlaps the working coil 310. The pressure sensor 800 detects the change in pressure, and determines whether cooking equipment is placed on the upper plate 222 of the second case 220 that overlaps the working coil 310 based on the detected change in pressure. Specifically, the pressure sensor 800 is disposed at a region of the upper plate 222 of the second case 220 that overlaps the working coil 310 in the vertical direction, and determines whether cooking equipment is placed within the range of operation of the working coil 310. Here, the vertical direction refers to the direction indicated by arrow U-D in FIG. 3.

The case further includes a slip prevention member 400 for increasing the frictional force between the case and the plate 11. The slip prevention member 400 is formed of a rubber or resin material, which has a higher friction coefficient than the material of the case. The slip prevention member 400 is disposed at the top surface of the upper plate 212 of the first case 210 and/or the bottom surface of the lower plate 221 of the second case 220. Preferably, in order to maximize the frictional force using the load of the cooking equipment placed on the upper plate 222 of the second case 220, the slip prevention member 400 is disposed at the region of the lower plate 221 of the second case 220 that overlaps the working coil 310 in the vertical direction.

Here, the insertion space 240 is the space defined between the upper plate 212 of the first case 210 and the lower plate 221 of the second case 220. The insertion space 240 may have various shapes depending on the shape of the plate 11. Preferably, the first case 210 and the second case 220 are disposed parallel to each other. Specifically, the upper plate 212 of the first case 210 and the lower plate 221 of the second case 220 are disposed parallel to each other. Here, "parallel" is not limited to a mathematically perfect parallel state, but may include a substantially parallel state that falls within a predetermined error range in accordance with an engineering concept.

The connection case 230 connects the first case 210 and the second case 220. The connection case 230 connects the first case 210 and the second case 220 so that they are spaced apart from each other. The height of the insertion space 240 is determined by the length of the connection case 230. A cable 320 for electrically connecting the working coil 310 and the power supply unit 330 may be disposed in the connection case 230. Preferably, the connection case 230 connects one end of the first case 210 and one end of the second case 220.

The connection case 230 may be formed by engaging at least two members. The connection case 230 includes an outer plate 232 and an inner plate 231, which are arranged to define a space therebetween. The inner plate 231 of the connection case 230 is exposed to the insertion space 240, and the outer plate 232 of the connection case 230 is arranged to face the inner plate 231 and is exposed to the outside. The outer plate 232 of the connection case 230 connects the lower plate 211 of the first case 210 and the upper plate 222 of the second case 220, and the inner plate 231 of the connection case 230 connects the upper plate 212 of the first case 210 and the lower plate 221 of the second case 220.

The embodiment further comprises a controller 250 for generating control signals in response to user's control commands transmitted thereto. The controller 250 controls the induction heating device 20 in response to user's control commands. The controller 250 controls the induction heating device 20 on the basis of information obtained by the pressure sensor 800.

The controller 250 is disposed at the case. Specifically, the controller 250 is mounted to the upper plate 222 of the second case 220 so as to be exposed to the outside. Various input members may be employed in the controller 250. For instance, a touch sensor or a physical input button may be employed in the controller 250.

Figure 4:
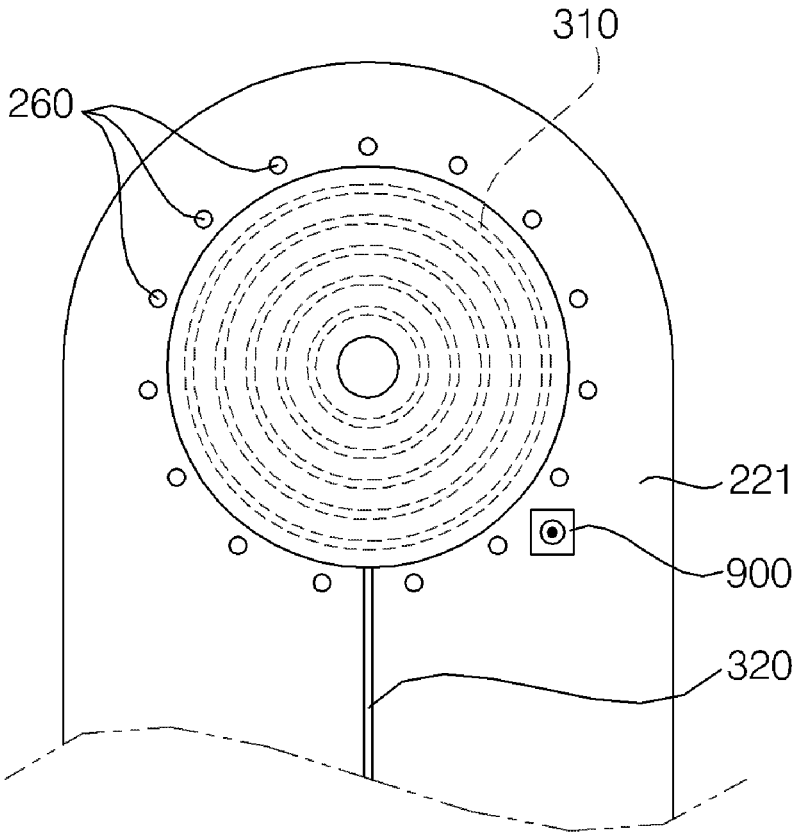
FIG. 4 is a view of a working coil and peripheral components of the induction heating device according to the first embodiment of the present invention when viewed from above.

FIG. 4 is a view of the working coil 310 and the peripheral components of the induction heating device 20 according to the first embodiment of the present invention when viewed from above.

Specifically, FIG. 4 illustrates the working coil 310 and the lower plate 221 of the second case 220 when viewed from above in the state in which the upper plate 222 of the second case 220 is removed.

The embodiment may comprise a light source 260 for indicating the boundary of the operation region within which cooking equipment placed on the case can be heated or electronic equipment can be operated. For instance, the boundary of the operation region within which the induction heating device 20 can perform the induction of eddy currents in cooking equipment may be indicated by a single light source 260 and a plurality of light guides (not shown) or by a plurality of light sources 260.

The light source 260 generates light. The light source 260 is electrically connected with the controller 250 and/or the induction heating device 20 so as to indicate the operational state of the induction heating device 20 or to indicate the region of the case within which cooking equipment or electronic equipment is to be positioned.

The light source 260 may include one or more light-emitting elements, and the light-emitting elements may be divided into a plurality of groups. Each light-emitting element may be a light-emitting diode (LED) chip that emits any one of red light, green light and blue light. A plurality of light-emitting elements may be configured to respectively emit white light for illumination, or red LEDs, green LEDs and blue LEDs may be combined so as to emit light of a specific color or white light.

As an example, the light source 260 is disposed at the second case 220. A plurality of light-emitting elements may be arranged in a specific shape or in a line. As shown in FIG. 4, a plurality of light sources 260 may be arranged along at least a portion of the periphery of the working coil 310.

Described in more detail, a plurality of light sources 260 is mounted on the lower plate 221 of the second case 220. When viewed from above, the light sources 260 are arranged on at least a portion of an imaginary curve, which surrounds the working coil 310, on the lower plate 221 of the second case 220.

Therefore, the light sources 260 enable a user to recognize the region within which cooking equipment or electronic equipment placed on the second case 220 can be operated, with the result that the user is capable of easily determining the position at which cooking equipment or electronic equipment is to be placed.

The induction heating device 20 may be provided with a radio frequency identification (RFID) reader 900 for receiving information about an RFID tag mounted on cooking equipment or electronic equipment. The RFID reader 900 transmits the received information about the RFID tag to the controller 250. The controller 250 controls the operation/non-operation state and the operation level of the induction heating device 20 in response to the received information about the RFID tag. Preferably, the RFID reader 900 is disposed near the working coil 310.

Hereinafter, various embodiments in which the dimensions of the insertion space 240 are adjusted depending on the thickness of the plate 11 of the table 10 will be described.

Figure 5:
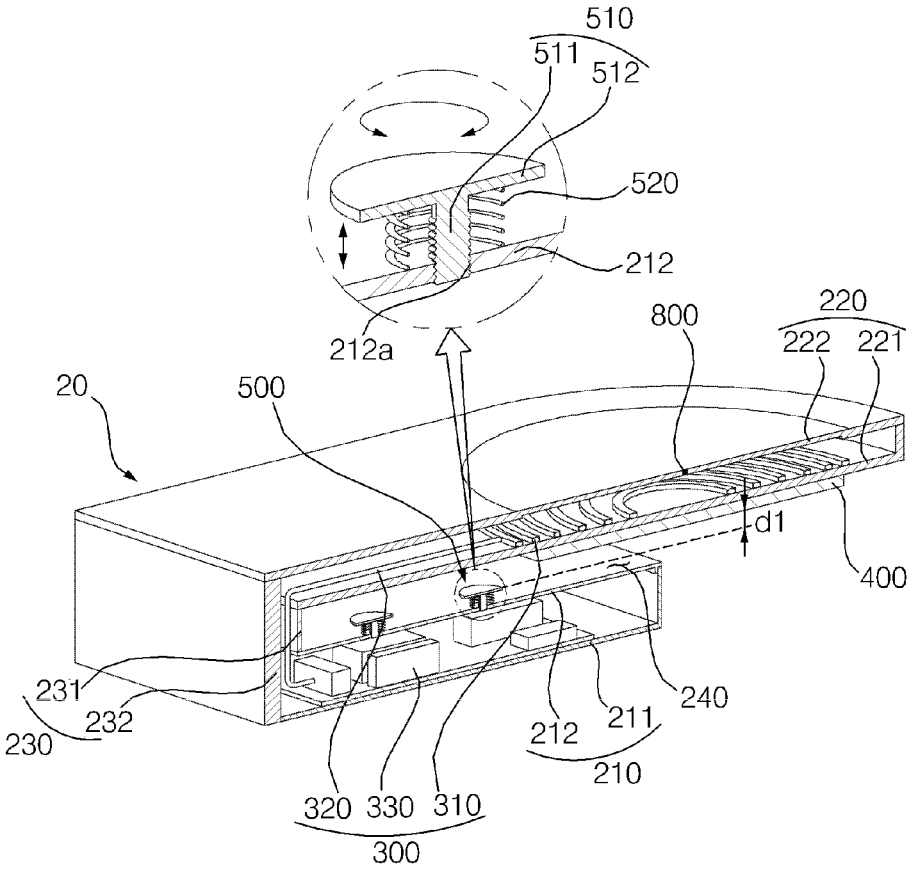
FIG. 5 is a sectional view of an induction heating device according to a second embodiment of the present invention.

FIG. 5 is a sectional view of an induction heating device according to a second embodiment of the present invention.

Referring to FIG. 5, an induction heating device 20 according to the second embodiment of the present invention further comprises a height adjustment unit 500, unlike the first embodiment. Hereinafter, the difference from the construction of the first embodiment will be primarily described, and an explanation of the components that are the same as those in the first embodiment will be omitted.

The height adjustment unit 500 is coupled to the first case 210 or the second case 220 so as to adjust the height d1 of the insertion space 240. Here, the height d1 of the insertion space 240 is the distance between the height adjustment unit 500 and the upper plate 212 of the first case 210 or the distance between the height adjustment unit 500 and the lower plate 221 of the second case 220.

As a result of the height adjustment unit 500 adjusting the height of the insertion space 240, it is possible to secure the induction heating device 20 to a table 10 having various dimensions and shapes.

For example, the height adjustment unit 500 may include an adjustment screw 510, which is vertically moved by rotation thereof so as to adjust the height of the insertion space 240.

The adjustment screw 510 is threaded into a coupling hole formed in the first case 210 or the second case 220, and is vertically moved by rotation thereof so as to adjust the height of the insertion space 240. Here, the coupling hole 212*a* is formed in the surface of the first case 210 that faces the second case 220. Specifically, the coupling hole 212*a* is formed through the upper plate 212 of the first case 210 or is formed through the lower plate 221 of the second case 220.

The adjustment screw 510 may be provided so as to protrude from the first case 210 or the second case 220 toward the insertion space 240. Specifically, the adjustment screw 510 is threaded into the coupling hole (not shown) formed in the lower plate 221 of the second case 220 so as to extend into the insertion space 240, or is threaded into the coupling hole 212*a* formed in the upper plate 212 of the first case 210 so as to extend into the insertion space 240.

The adjustment screw 510 includes a body 511, which has threads formed around the outer surface thereof so as to be threaded into the coupling hole 212*a*, and a head 512, which is connected with one end of the body 511 and has a larger width than the body 511. The head 512 serves as a knob and also functions to support the plate 11 fitted into the insertion space 240.

The adjustment screw 510 may be provided in a plural number. The height adjustment unit 500 may further include an elastic member. The elastic member limits the rotation of the adjustment screw 510 so as to prevent the adjustment screw 510 from being rotated by external force of a predetermined level or less. The elastic member is, for example, a coil spring 520, which has one end supported by the body 511 and the other end supported by the case, thereby providing elastic force between the body 511 and the case. The coil spring 520 is disposed around the body 511.

Figure 6:
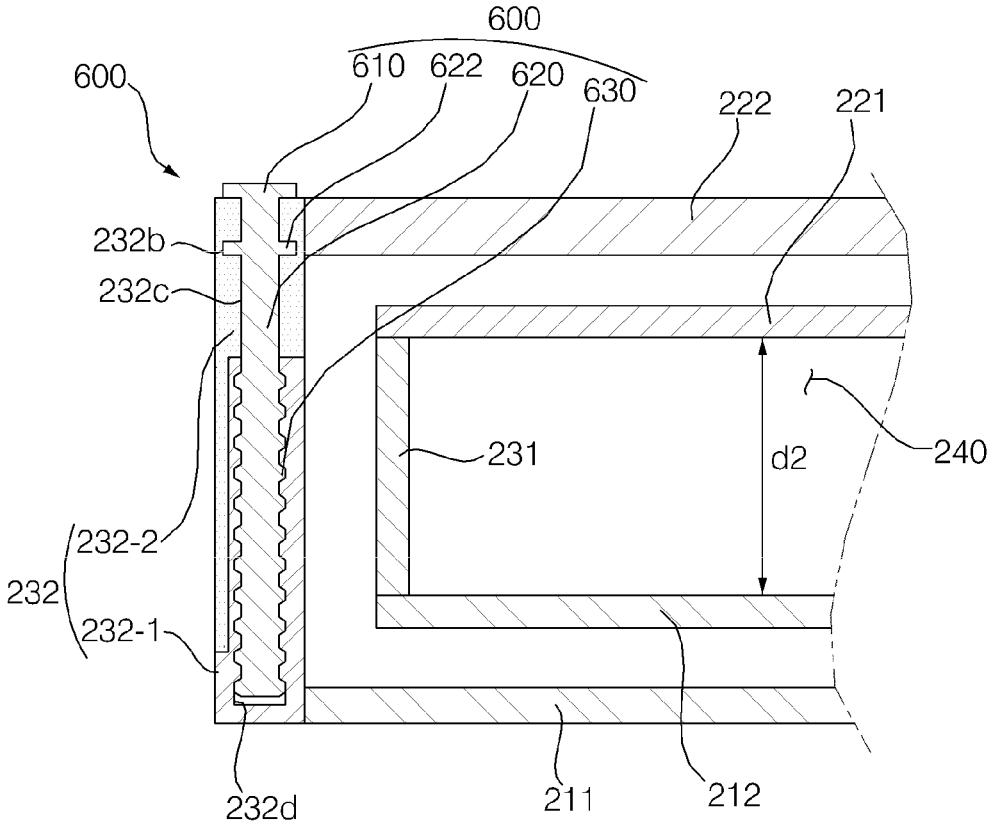
FIG. 6 is a sectional view of an induction heating device according to a third embodiment of the present invention.
Figure 7:
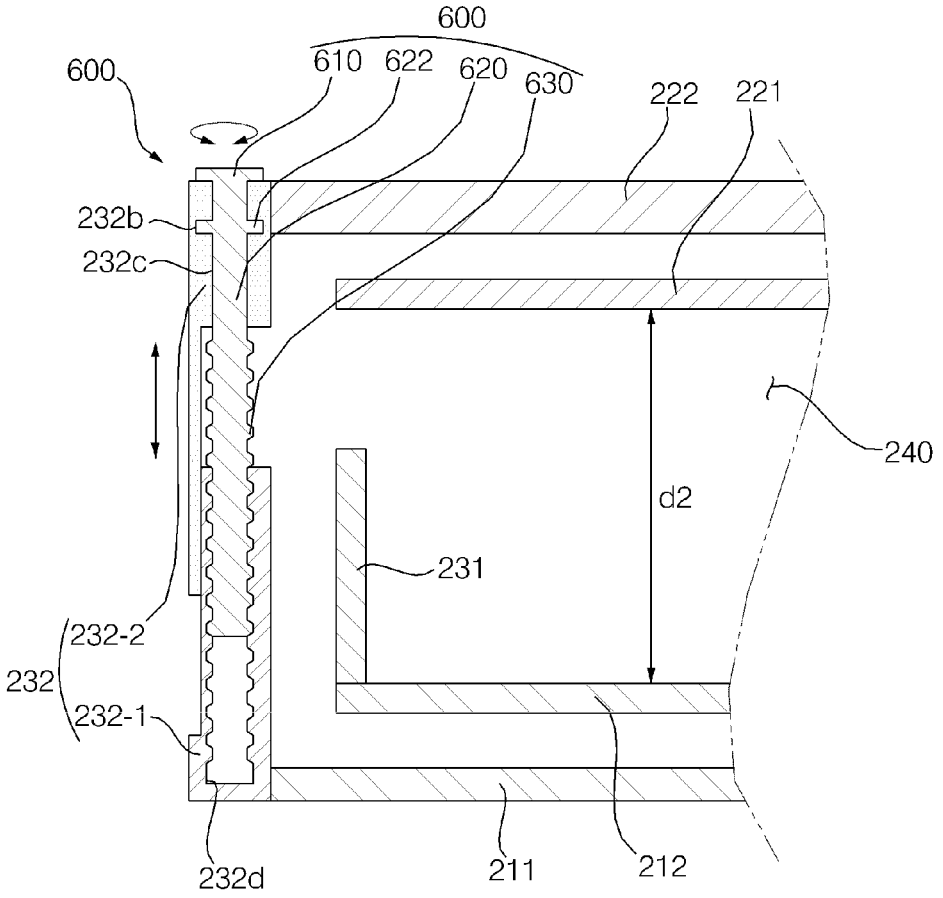
FIG. 7 is a reference view illustrating the operation of the induction heating device according to the third embodiment of the present invention.

FIG. 6 is a sectional view of an induction heating device according to a third embodiment of the present invention, and FIG. 7 is a reference view illustrating the operation of the induction heating device according to the third embodiment of the present invention.

Referring to FIGS. 6 and 7, an induction heating device 20 according to the third embodiment of the present invention further comprises a distance adjustment unit 600, unlike the first embodiment.

The distance adjustment unit 600 adjusts the distance between the first case 210 and the second case 220. Here, the distance between the first case 210 and the second case 220 is the distance d2 between the upper plate 212 of the first case 210 and the lower plate 221 of the second case 220.

As a result of the distance adjustment unit 600 adjusting the dimension of the insertion space 240, it is possible to secure the induction heating device 20 to a table 10 having various dimensions and shapes.

As an example, the distance adjustment unit 600 may adjust the length of the connection case 230.

Specifically, the connection case 230 includes a first connection case 232-1 and a second connection case 232-2.

One end of the first connection case 232-1 is connected with the first case 210, and one end of the second connection case 232-2 is connected with the second case 220. The first connection case 232-1 and the second connection case 232-2 are not connected to each other.

More specifically, the first connection case 232-1 and the second connection case 232-2 are formed by division of the outer plate 232 of the connection case 230 into two members. The first connection case 232-1 is connected with the lower plate 211 of the first case 210, and the second connection case 232-2 is connected with the upper plate 222 of the second case 220. The inner plate 231 of the connection case 230 is connected with the first case 210, but is not connected with the second case 220. When the length of the connection case 230 is increased, the separation distance between the inner plate 231 of the connection case 230 and the second case 220 is increased.

The distance adjustment unit 600 includes a rotating screw, which is threaded into a screw hole 232*d* formed in the first connection case 232-1 and which extends through the second connection case 232-2 so as to vertically move the first connection case 232-1 by rotation thereof. The separation distance between the first connection case 232-1 and the second connection case 232-2 is adjusted by the rotation of the rotating screw, and consequently the dimensions of the insertion space 240 are adjusted.

Specifically, the rotating screw is threaded into the screw hole 232*d* formed in the first connection case 232-1, and is coupled to the second connection case 232-2 such that vertical movement thereof is inhibited and rotation thereof is permitted. The second connection case 232-2 has a through-hole 232*c* therein, through which the rotating screw passes, and the through-hole 232*c* has a vertical-movement-preventing recess 232*b* therein, which inhibits vertical movement of the rotating screw and permits rotation of the rotating screw.

The rotating screw further includes a vertical-movement-preventing protrusion 622, which is inserted into the vertical-movement-preventing recess 232*b*. Specifically, the rotating screw includes a body 620 having threads formed around the outer surface thereof, and a screw head 610 extending from one end of the body 620 so as to have a larger width than the body 620 and to be exposed to the outside of the connection case 230. The vertical-movement-preventing protrusion 622 protrudes from the outer peripheral surface of the body 620.

The rotating screw is rotated along the vertical-movement-preventing recess 232*b* while being inhibited from moving vertically in the second connection case 232-2, and moves vertically while being rotated along the threads in the screw hole 232*d* formed in the first connection case 232-1. As a result, the separation distance between the first connection case 232-1 and the second connection case 232-2 is adjusted by the rotation of the rotating screw.

The connection case 230 further includes a shielding film 232*a* for shielding the separation space between the first connection case 232-1 and the second connection case 232-2. When the first connection case 232-1 and the second connection case 232-2 are separated from each other by the rotation of the rotating screw, the separation space therebetween is prevented from being exposed to the outside due to the shielding film 232*a*. For instance, the shielding film 232*a* may extend from any one of the first connection case 232-1 and the second connection case 232-2 so as to cover the other one thereof.

Figure 8A:
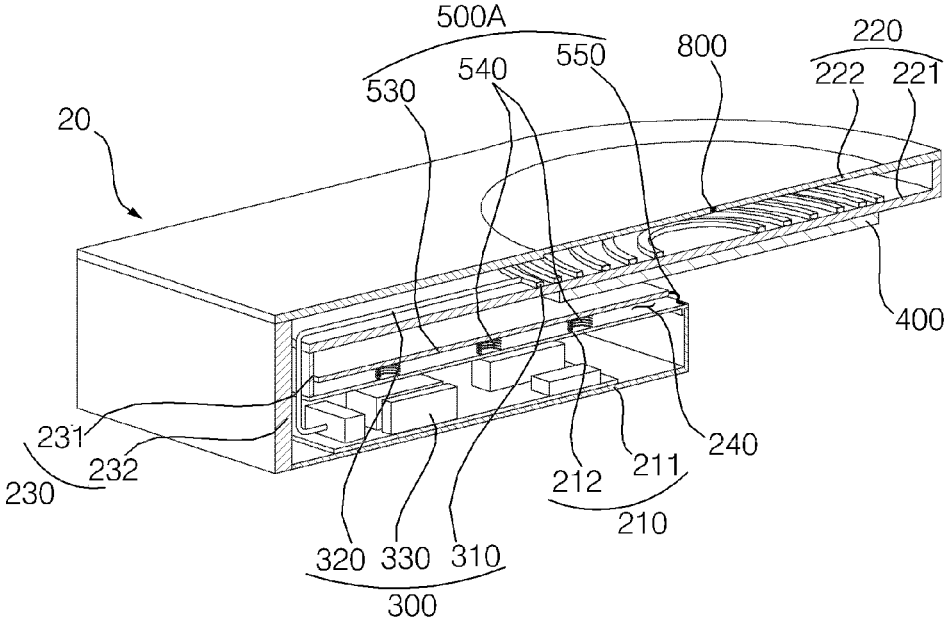
FIG. 8*a* is a sectional view of an induction heating device according to a fourth embodiment of the present invention.
Figure 8B:
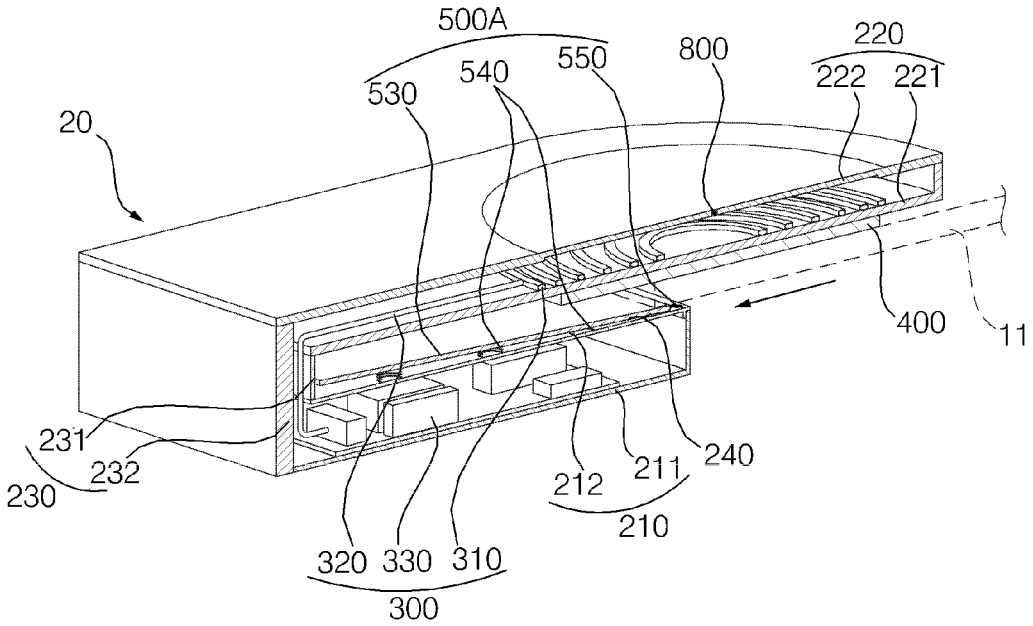
FIG. 8*b* is a reference view illustrating the operation of the induction heating device according to the fourth embodiment of the present invention.

FIG. 8*a* is a sectional view of an induction heating device according to a fourth embodiment of the present invention, and FIG. 8*b* is a reference view illustrating the operation of the induction heating device according to the fourth embodiment of the present invention.

Referring to FIGS. 8*a* and 8*b*, an induction heating device 20 according to the fourth embodiment of the present invention further comprises a height adjustment unit 500A, unlike the first embodiment.

The height adjustment unit 500A is coupled to the first case 210 or the second case 220 so as to adjust the height of the insertion space 240. Of course, the connection case 230 connects the first case 210 and the second case 220.

As an example, the height adjustment unit 500A includes an elastic member 540, which is secured to the case, and a support member 530, which is supported by the elastic member 540 so as to adjust the height of the insertion space 240 using the elastic force of the elastic member 540. Here, the height of the insertion space 240 refers to the distance between the support member 530 and the first case 210 or the second case 220.

Specifically, the elastic member 540 is secured to the first case 210, and has elastic restoring force, which is exerted toward the second case 220 from the first case 210. The elastic member 540 is secured to the upper plate 212 of the first case 210.

The support member 530 is supported by the elastic member 540, and the insertion space 240 is defined between the support member 530 and the second case 220. The support member 530 may have a plate shape and may be arranged parallel to the lower plate 221 of the second case 220. Alternatively, the elastic member 540 may be secured to the second case 220 so that the insertion space 240 is defined between the support member 530 and the first case 210.

The height of the insertion space 240 is adjusted by the change in distance between the second case 220 and the support member 530 due to the elastic force of the elastic member 540. Therefore, the height of the insertion space 240 varies depending on the thickness of the plate 11 of the table 10, and the induction heating device 20 is stably secured to the plate 11 by the elastic force of the elastic member 540.

The embodiment further comprises a cover 550, which is made of a flexible material and connects the edge portion of the support member 530 and the first case 210, in order to ensure smooth insertion of the plate 11 of the table 10 into the insertion space 240 and to prevent the plate 11 from being inserted into a space between the support member 530 and the upper plate 212 of the first case 210 to which the elastic member 540 is secured.

The cover 550 changes in length and shape depending on the movement of the support member 530, with the result that the space between the support member 530 and the upper plate 212 of the first case 210 is shielded from the outside by the cover 550. One end of the cover 550 is connected with the upper plate 212 of the first case 210, and the other end of the cover 550 is connected with at least a portion of the edge of the support member 530. Preferably, the cover 550 connects a portion of the edge of the support member 530 that is located opposite the connection case 230 and a portion of the upper plate 212 of the first case 210 that is located opposite the connection case 230.

Figure 9:
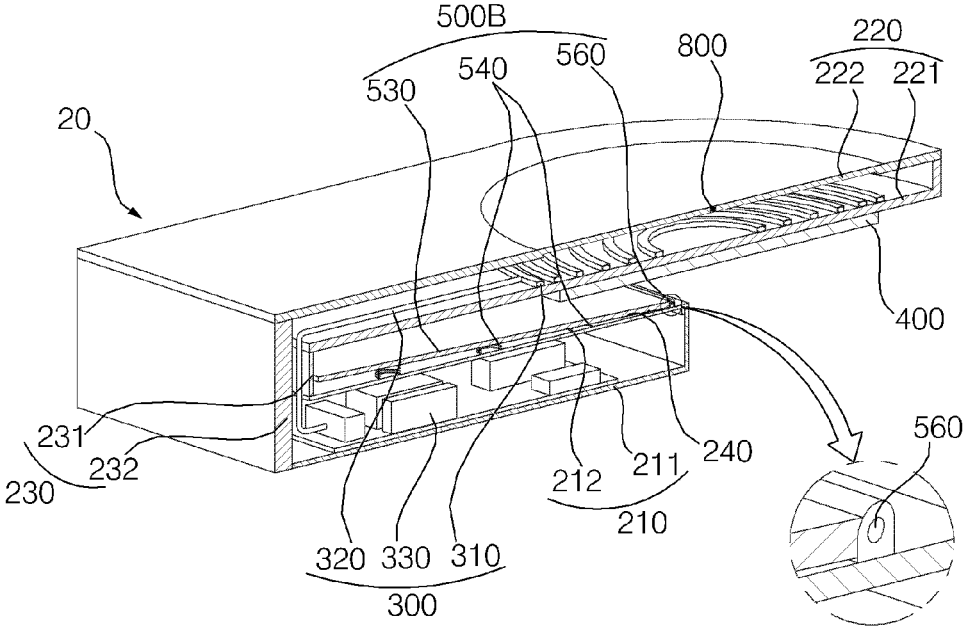
FIG. 9 is a sectional view of an induction heating device according to a fifth embodiment of the present invention.

FIG. 9 is a sectional view of an induction heating device 20 according to a fifth embodiment of the present invention.

Referring to FIG. 9, an induction heating device 20 according to the fifth embodiment of the present invention further comprises a hinge 560, unlike the fourth embodiment, and the cover 550 in the fourth embodiment is eliminated from the fifth embodiment.

That is, a height adjustment unit 500B in the fifth embodiment is coupled to the first case 210 or the second case 220 so as to adjust the height of the insertion space 240.

As an example, the height adjustment unit 500B may include an elastic member 540, which is secured to the first case 210, a support member 530, which is supported by the elastic member 540 so as to adjust the height of the insertion space 240 using the elastic force of the elastic member 540, and a hinge 560, which connects the upper plate 212 of the first case 210 and the support member 530 so that the support member 530 swings about the hinge.

As a result of one end of the support member 530 being hingedly coupled to the first case 210, the plate 11 of the table 10 is smoothly fitted into the insertion space 240, and the plate 11 is prevented from being inserted into the space between the support member 530 and the upper plate 212 of the first case 210.

The support member 530 is vertically moved by the elastic force of the elastic member 540, and swings about one end of the first case 210.

The hinge 560 connects the upper plate 212 of the first case 210 and the support member 530 so that the support member 530 swings about the hinge 560. Specifically, the hinge 560 rotatably connects the edge of the support member 530 to the upper plate 212 of the first case 210. Preferably, the hinge 560 rotatably connects the one end of the support member 530 that is located opposite the connection case 230 to the one end of the upper plate 212 of the first case 210 that is located opposite the connection case 230.

As is apparent from the above description, the present invention provides an induction heating device, which is constructed such that an insertion space, into which a plate is fitted, is defined between a first case and a second case and such that one of the first case and the second case is located on the plate and the other one is located beneath the plate, thereby making it possible to reduce the thickness of the upper region, which is located on the plate and can be seen by a user.

Further, the induction heating device may be easily mounted to or demounted from a plate of a table due to the insertion space defined between the first case and the second case, into which the plate is fitted.

Further, the height of the insertion space is adjusted by a height adjustment unit, which makes it possible to secure the induction heating device to tables having various dimensions and shapes.

Further, the distance between the first case and the second case is adjusted by a distance adjustment unit, which makes it possible to secure the induction heating device to tables having various dimensions and shapes.

In addition, a user may easily recognize the position at which cooking equipment or electronic equipment is to be placed.

The above described features, configurations, effects, and the like are included in at least one of the embodiments of the present invention, and should not be limited to only one embodiment. In addition, the features, configurations, effects, and the like as illustrated in each embodiment may be implemented with regard to other embodiments as they are combined with one another or modified by those skilled in the art. Thus, content related to these combinations and modifications should be construed as being included in the scope and spirit of the invention as disclosed in the accompanying claims.

What is claimed is:

1. An induction heating device comprising:

a working coil for creating a magnetic field for induction of eddy currents in cooking equipment so as to heat the cooking equipment;

a power supply unit for providing induction voltage to operate the working coil; and a case for accommodating the power supply unit and the working coil, the case including a first case, a second case, and a connection case that connects the first case to the second case, wherein the first case, the second case, and the connection case define an insertion space within the case that is configured to accommodate a plate.

2. The induction heating device according to claim 1, wherein the power supply unit is disposed in the first case and the working coil is disposed in the second case.

3. The induction heating device according to claim 1, wherein the first case and the second case are disposed parallel to each other.

4. The induction heating device according to claim 1, further comprising:

a height adjustment unit coupled to one selected from between the first case and the second case so as to adjust a height of the insertion space.

5. The induction heating device according to claim 4, wherein the height adjustment unit includes an adjustment screw threaded into a coupling hole formed in one selected from between the first case and the second case and configured to be vertically moved by rotation thereof so as to adjust the height of the insertion space.

6. The induction heating device according to claim 5, wherein the coupling hole is formed in a surface of the first case that faces the second case.

7. The induction heating device according to claim 4, wherein the height adjustment unit includes:

an elastic member secured to the first case; and a support member supported by the elastic member, wherein the insertion space is defined between the support member and the second case, and a distance between the support member and the second case is adjusted by elastic force of the elastic member.

8. The induction heating device according to claim 7, wherein the support member is hingedly coupled at one end thereof to the first case.

9. The induction heating device according to claim 7, further comprising:

a cover made of a flexible material, the cover connecting an edge portion of the support member and the first case.

10. The induction heating device according to claim 1, further comprising:

a cable disposed in the connection case so as to electrically connect the working coil and the power supply unit.

11. The induction heating device according to claim 1, further comprising:

a distance adjustment unit for adjusting a distance between the first case and the second case.

12. The induction heating device according to claim 11, wherein the distance adjustment unit adjusts a length of the connection case.

13. The induction heating device according to claim 11, wherein the connection case includes a first connection case connected at one end thereof to the first case and a second connection case connected at one end thereof to the second case, and wherein the distance adjustment unit includes a rotating screw threaded into a screw hole formed in the first connection case and extending through the second connection case so as to vertically move the first connection case due to rotation thereof.

14. The induction heating device according to claim 13, wherein the rotating screw is coupled to the second connection case such that vertical movement thereof is inhibited and rotation thereof is permitted.

15. The induction heating device according to claim 13, wherein the connection case further includes a shielding film for shielding a separation space between the first connection case and the second connection case.

16. The induction heating device according to claim 1, wherein the connection case defines a connection space that connects an inner space of the first case to an inner space of the second case.

17. An induction heating device comprising:

a working coil for creating a magnetic field for induction of eddy currents in cooking equipment so as to heat the cooking equipment;

a power supply unit for providing induction voltage to operate the working coil;

a case for accommodating the power supply unit and the working coil, the case including a first case, a second case, and a connection case that connects the first case to the second case, wherein the first case, and the second case, and the connection case define an insertion space within the case that is configured to accommodate a plate; and a height adjustment unit coupled to one selected from between the first case and the second case and configured to adjust a height of the insertion space.

18. The induction heating device according to claim 17, wherein the height adjustment unit includes an adjustment screw threaded into a coupling hole formed in one selected from between the first case and the second case and configured to be vertically moved by rotation thereof so as to adjust the height of the insertion space.

19. The induction heating device according to claim 17, wherein the height adjustment unit includes:

an elastic member secured to the first case; and a support member supported by the elastic member, wherein the insertion space is defined between the support member and the second case, and a distance between the support member and the second case is adjusted by elastic force of the elastic member.

20. The induction heating device according to claim 19, further comprising:

a cover made of a flexible material, the cover connecting an edge portion of the support member and the first case.

* * * * *